United States Patent [19]

Wizemann et al.

[11] Patent Number: 4,458,638

[45] Date of Patent: Jul. 10, 1984

[54] IGNITION DISTRIBUTOR ADVANCE PLATE

[75] Inventors: Werner O. Wizemann; W. Jim Savage, Jr., both of Carson City, Nev.

[73] Assignee: Super Shops, Inc., Newport Beach, Calif.

[21] Appl. No.: 312,843

[22] Filed: Oct. 19, 1981

[51] Int. Cl.[3] ..... F02P 7/06

[52] U.S. Cl. ..... 123/146.5 A; 200/19 R; 200/31 DP

[58] Field of Search ..... 123/146.5 A, 146.5 R; 200/19 R, 31 DP, 31 CA, 31 V, 22

[56] References Cited

U.S. PATENT DOCUMENTS

| | | | |
|---|---|---|---|
| 1,934,199 | 11/1933 | Martin | 123/146.5 A |
| 2,610,264 | 9/1952 | Fitzsimmons | 200/31 |
| 2,643,304 | 6/1953 | Lautzenhiser | 200/31 DP |
| 3,091,672 | 5/1963 | Longenecker | 200/31 DP |
| 3,577,970 | 5/1971 | King et al. | 123/146.5 A |
| 3,668,339 | 6/1972 | Cooksey | 200/19 |
| 3,688,391 | 9/1972 | Cooksey | 29/598 |
| 4,033,315 | 7/1977 | Kröger et al. | 123/146.5 A |
| 4,078,161 | 3/1978 | Haug et al. | 200/19 R |
| 4,088,853 | 5/1978 | Brammer et al. | 200/19 R |

FOREIGN PATENT DOCUMENTS

| | | | |
|---|---|---|---|
| 55-60661 | 5/1980 | Japan | 123/146.5 A |
| 2010014 | 6/1979 | United Kingdom . | |

*Primary Examiner*—Andrew M. Dolinar

*Attorney, Agent, or Firm*—Browdy and Neimark

[57] ABSTRACT

An advance plate assembly comprising a slim thickness, measured along the axis of the distributor, and comprising improved means to mount the assembly in the distributor housing. The invention also comprises one of a plurality of finger springs which hold the plate in any position securely, and yet permit easy changing of the position. Two different forms, one using set screws and the other using a split spring ring, to hold the assembly in the distributor housing are also disclosed. Improved means comprising a tongue on the finger spring which fits in a notch in the main bushing of the assembly is also disclosed.

12 Claims, 11 Drawing Figures

FIG. 1
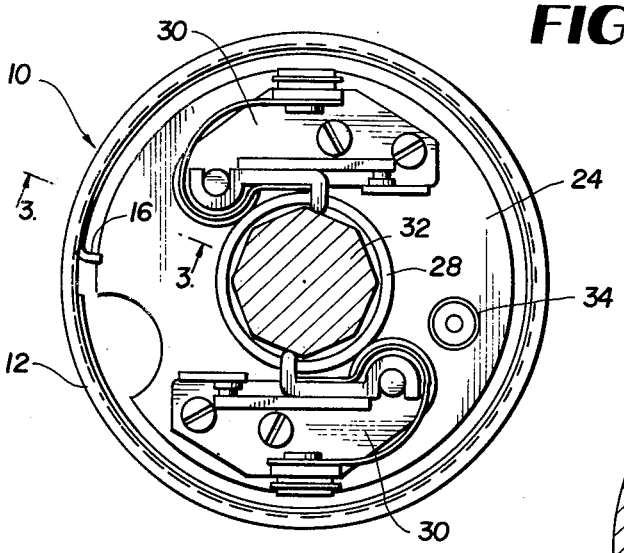
FIG. 2
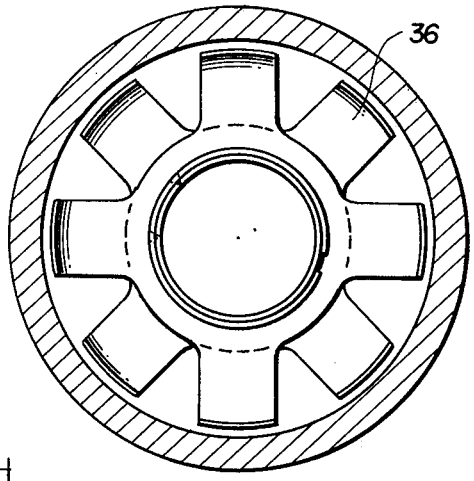
FIG. 3
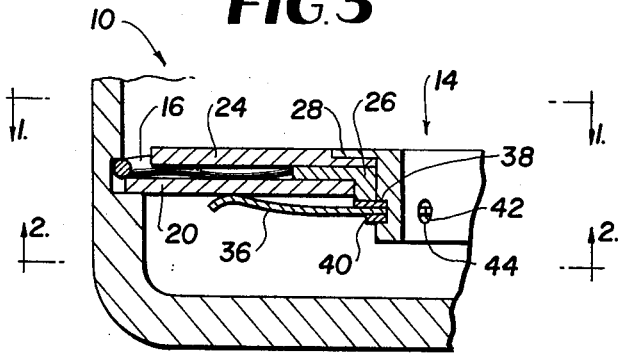
FIG. 4
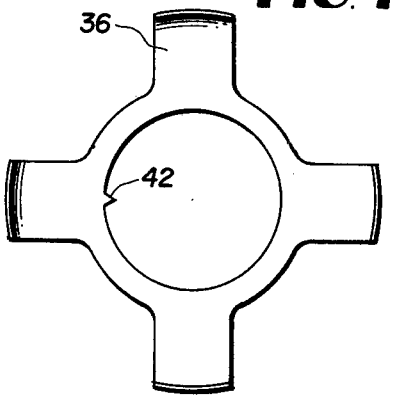
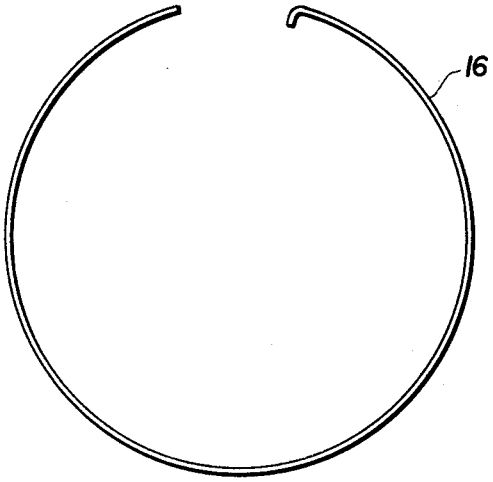
FIG. 5
FIG. 6
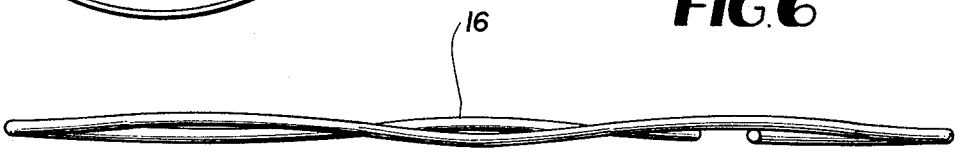

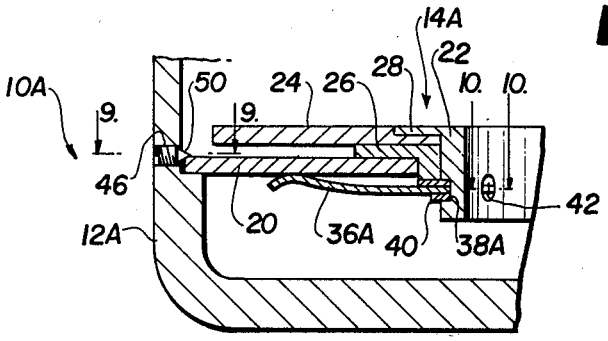
FIG.7
FIG.8A
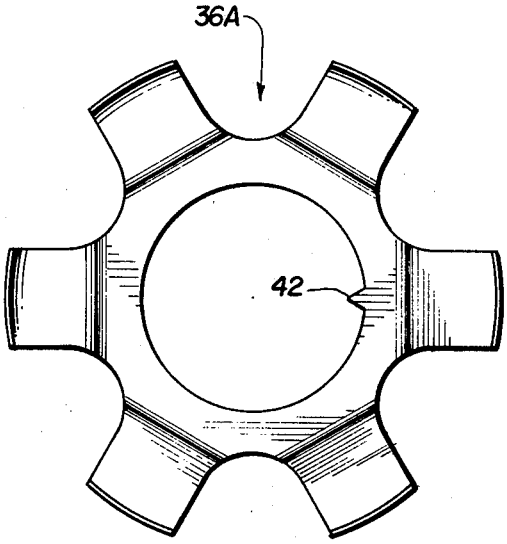
FIG.8B
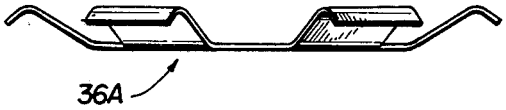
FIG.9
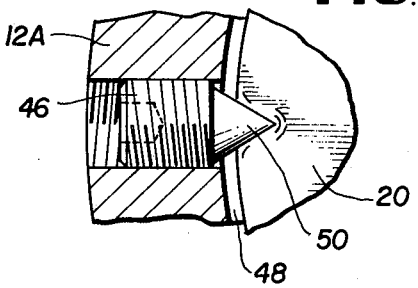
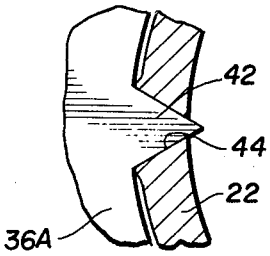
FIG.10

IGNITION DISTRIBUTOR ADVANCE PLATE

DETAILED SPECIFICATION

This invention relates to ignition for internal combustion engines, particularly automobile engines. More in particular, the invention pertains to an improved spark advance distributor plate assembly for use in the distributors of such engines.

The commonly used Kettering ignition system comprises at least one set of breaker points which are carried within the distributor on a support plate. This support plate moves around the axis of the distributor shaft to advance or retard the ignition with regard to the operation of the engine. Typically, a vacuum means are provided to cause this motion of the support plate carrying the breaker contacts.

The present invention is directed to a number of problems in this area. It is important that the distributor overall be as small and as lightweight as possible in order to fit into relatively small spaces in the engine compartment, and to reduce weight. Further, it is very important that once the plate is moved to some adjusted position by the vacuum advance means, that it remains securely in that position until it is again moved. The distributor is subjected to a great deal of shock and motion, since the center rotor driven by the distributor shaft breaks the breaker contacts, and this causes substantial vibration and motion of the parts tending to change the relative position of the support plate in the distributor. These problems are amplified and made even more severe in the high demands of racing or other performance applications, especially where, in such applications, dual breaker point systems are often used.

The invention provides a finger spring, which makes for a reduction in thickness along the axis assembly, and which also securely urges the assembly of the support plate, the movable plate and the various bushings snuggly together. This finger spring also provides vibration dampening, thus holding all of the electronic and mechanical systems stationary, and securely in place in the distributor in use, even under the severe conditions of racing and other high performance uses. In many other designs, motion could occur between the support plate and the spring to separate the assembly. This situation, with its many disadvantages of inviting vibration and loosening of parts, is avoided by providing a locking tongue on the inside edge of the finger spring which fits into a hole provided in the main bushing, to thereby lock the finger spring in one relative position with respect to that bushing. Another clip member holds the finger spring securely in place on the main bushing.

Another facet of the improvement of the invention has to do with the manner in which the entire assemblage of the breaker plates, the stationary plate and the finger spring with the main bushing is held in place in the distributor housing. Two forms of such apparatus are taught herein; one comprising a split spring ring which fits in a suitable groove in the inside of the distributor housing which receives the edge of the stationary plate and that retaining spring. The second form comprises a pair of pointed set screws which fit into suitably formed openings in the sides of the distributor housing and which "bite" into the stationary plate to hold it in a fixed position. This form requires a simple shoulder to be formed on the inside of the distributor housing to receive the edge of the stationary plate of the breaker assembly.

Conventional advance plates include at least two and sometimes three mounting ears provided on the periphery of the plates in the breaker assembly, which ears extend along the axis of the distributor. These mounting ears are typically bent up or down and require complex techniques for mounting them to the inside walls of the distributor bowl. Other prior art assemblies include bosses or the like which protrude inwardly from the inside of the bottom or the sides of the distributor bowl. These require enlargement of the bowl diameters to accommodate centrifugal and vacuum advance parts. The bent ear arrangements require deep bowls to avoid interference of the mounting ears with the centrifugal advance mechanisms.

Heretofore, prior to the present invention, certain distributors could not have advance mechanisms and a substantially small enough size to be used in certain applications.

In addition, the features of the invention as set forth above provide numerous advantages in the area of ease of assembly, very compact size, reductions in weight, reductions in cost of manufacturing and of parts, and very quick and easy interchangeability of the parts without any special tools. That is, the entire breaker assembly can be removed with only an Allen wrench in the case of the set screw embodiment, or with an ordinary set of pliers in the case of the spring ring retainer embodiment. This is opposed to the prior art including these upstanding ears which require special screw drivers and other special tools to reach inside the bowl to remove the ignition advance assembly.

When applied to ignitions using dual breaker points, central pivoting on a very secure and sturdy bearing is absolutely necessary. Most prior art designs use very expensive and heavy ball bearings to minimize the bearing play to secure this necessary modus operandi. The invention assembly has only one radial bearing device which is machined to a very snug sliding fit between the main bushing and the stationary plate. This is held securely in that position by the strong finger spring of the invention. The finger spring in turn is held against motion by the interfitting of its tongue with the main bushing. The finger spring eliminates all axial play by urging the stationary and movable plates snuggly together via the main bushing.

The tongue itself on the finger spring is made in a tapered form, so that it is forced into its opening in the main bushing, thus preventing any motion at that interface, namely between the bushing and the finger spring where they mate together. The finger spring tongue is literally forced into the opening, slightly deforming the metal of the bushing, to secure this tight fit, while not having any effect at all on the normal operation of the main bushing. As still another feature, where necessary, two finger springs can be used in a stacked relationship, thus increasing the thickness, axially of the assembly, only insignificantly, the finger springs being made of very thin material while providing a doubly strong hold between the parts holding them together. Two such finger springs, secured by the tongues at spaced positions around the bushing from each other, provide smoother motion by evenly distributing the friction force provided by those springs all around the stationary plate.

The net result of the invention is an improved design having a reduced cost of manufacture, improved ease of interchangeability, reduced time of assembly, increased horse-power and improved gas mileage in vehicles using the invention design, higher reliability, smaller size, and lighter weight, all while providing a device of the character described, highly efficient in use, and highly practical for its intended purposes.

The above and other advantages of the invention will be pointed out or will become evident in the following detailed description and claims, and in the accompanying drawings also forming a part of the disclosure, in which:

FIG. 1 is a top plan view of an ignition advance assembly embodying a invention mounted in the distributor taken generally along the line 1—1 of FIG. 3;

FIG. 2 is a bottom plan view thereof taken generally along the line 2—2 of FIG. 3;

FIG. 3 is a partial vertical elevational sectional view taken along line 3—3 of FIG. 1;

FIG. 4 is a bottom plan view of one of the two four-armed finger springs used in FIGS. 1, 2, and 3;

FIG. 5 is a plan view of the retention spring used in this first embodiment of FIGS. 1 through 4;

FIG. 6 is a side enlarged elevational view of the spring of FIG. 5;

FIG. 7 is a view similar to FIG. 3 showing a second embodiment of the invention;

FIGS. 8*a* and 8*b* are plan and side elevational views of the six-armed finger spring used in the second embodiment; and FIGS. 9 and 10 are partial sectional views illustrating details and taken on lines 9—9 and 10—10 of FIG. 7 respectively;

Referring now in detail to the drawings, a first embodiment 10 of the invention ignition advance assembly for distributors is shown. Embodiment 10 comprises a distributor bowl or housing 12 in which is mounted the ignition advance assembly 14 by means of a retaining spring 16. In this first embodiment 10 of FIGS. 1 through 3, the distributor bowl 12 is formed with a groove 18 to snuggly receive the stationary plate 20 of the assembly 14 and the retaining spring 16 to thereby snuggly hold the advance assembly 14 in place in bowl 12.

The ignition advance assembly 14 further comprises a main bushing 22, and a movable plate 24 mounted thereon in spaced relation to the stationary plate 20 by means of an intermediate bushing 26. The movable plate 24 and the main bushing 22 are secured together to move together by means of the interfitting flanges indicated at 28 in FIG. 3.

The movable plate 24 carries the ignition parts themselves, conventional dual breaker point assemblies 30 are shown in FIG. 1 (but are omitted in FIG. 3 for the sake of clarity of that showing), and these cooperate with the distributor shaft and operating cam 32, all in a manner well known to those skilled in the art and therefore not described in any further detail herein. The movable plate 24 also carries a conventional upstanding pin 34 which is connected to the vacuum advance means conventionally mounted outboard of the distributor housing or bowl 12, and also omitted for the sake of clarity. These vacuum advance means conventionally comprise a diaphram, and an operating rod, which extends through a suitable opening or slot in the side of the distributor 12 to cooperate with the pin 34. The motion of that rod on pin 34 causes spark advance or retardation by moving the plate 24 with respect to the stationary plate 20, to thereby advance or retard ignition by moving the breakers 30 with respect to the axis of the distributor shaft and the cam 32.

It is critically important, and especially so in racing and other high performance environments, which typically require dual breakers, as is shown in the drawings, that the parts be of lightweight, and do not move in use and do not vibrate with respect to each other. Conventionally, in such ignitions, ball bearings, and other complex heavy large mechanisms were provided to assure this sound and secure operation. All of this is avoided by the invention assembly as described so far.

The assembly 14 is held together by means of a pair of finger springs 36, each comprising four arms, as shown more clearly in FIGS. 2 and 4. The main bushing 22 is formed with a circumferential groove 38 on its outside surface to receive the pair of finger springs 36 together with a lock ring 40 to hold them in place in the groove 38.

Means are provided to permit the motion of the movable plate 24 together with the bushing 22 with respect to the stationary plate 20 while at the same time holding the entire assembly 14 securely together, and maintaining the two plates 20 and 24 securely, in a vibration free manner, at any adjusted position with respect to each other as is required of the ignition assembly in use. To this end, finger spring 36 is formed with a tongue 42 which very snuggly fits into, and in fact is slightly forced into during assembly, an opening 44 in the main bushing 22 in the vicinity of the groove 38 therein. These features can be seen in FIG. 3, and also in the second embodiment 10A, see FIG. 10. The fingers of the springs 36 or 36A provide the advantages of holding the parts snuggly together, and holding the parts in any adjusted position with respect to each other, due to the substantial amount of deformation to which they are subjected, thus producing a heavy spring load urging the plates 20 and 24 together. This can be seen by a comparison of FIGS. 7 and 8B or 3 and 8B which shows the spring in the relaxed and in the assembled conditions.

Referring now to FIGS. 7 through 10, a second embodiment 10A of the invention is shown. Parts the same as those described above are indicated by the same reference numeral, parts similar to those described above are indicated by the same reference numeral followed by "A". The second embodiment 10A illustrates two features different from what was shown in the preceding embodiment 10. One comprises a modified spring 36A, which, referring to FIGS. 8A and 8B, is seen to have six arms, rather than the four arms of the spring 36 of FIG. 4. The invention thus teaches the use of a spring having four, six, or eight arms, by using combinations of springs. The bushing 22 of FIG. 7 has the groove 38A modified to be slightly thinner since it need accommodate only one thickness of the spring 36A rather than two thicknesses as shown in FIG. 3. Of course, other numbers of spring arms on the spring 36 could be used depending upon the demands and conditions of their particular environment. The second feature has to do with the manner of retaining the stationary plate 20 of the assembly 14A in place. This comprises a pair (only one of which shown in FIG. 7) of set screws 46 provided in suitable threaded openings in the distributor bowl 12A which set screws replace the retention spring ring 16 of FIGS. 5 and 6. A cooresponding minor change in the bowl 12A is also required, namely the replacement of the groove 18 by a shoulder 48. As shown in FIG. 9, the parts are arranged such that the pointed end 50 of the set screw 46 bites into the metal of the stationary plate 20 to thereby hold it securely in place. This arrangement of the set screws 46 is preferred in certain environments due to its lower cost of parts and manufacture as compared to the spring ring 16.

The various different features, the finger springs having different numbers of fingers, the different retaining means, the different numbers of finger springs used, are all interchangeable. That is, one could use the six arm spring in the FIG. 3 embodiment by changing the groove 38 to the groove 38A, as one example. As another example, 1, 3 or some other number of the set screws 46 could be provided for different sizes and types of distributor bowls. Other changes in combinations of the features will be evident to those skilled in these arts.

While the invention has been described in detail above, it is to be understood that this detailed description is by way of example only, and the protection granted is to be limited only within the spirit of the invention and the scope of the following claims.

We claim:

1. In a distributor for the ignition of an internal combustion engine, the combination comprising a distributor housing, an ignition advance assembly in said housing, said assembly comprising a main bushing secured to a movable plate for motion together therewith, ignition means mounted on said movable plate, a stationary plate mounted on said main bushing to one side of said movable plate, means to permit relative rotational motion between said movable and said stationary plates of said assembly, means cooperable between said distributor housing and said ignition advance assembly stationary plate to removably but fixedly mount said assembly in said distributor housing, finger spring means mounted on said main bushing to securely hold said assembly of said stationary and movable plates together while permitting relative motion between said plates and while securely holding said stationary and movable plates in any adjusted relative position with respect to each other, and said finger spring means having at least one spring finger slidably bearing against said stationary plate on the side thereof opposite said movable plate.

2. The combination of claim 1, said mounting means cooperable between said distributor housing and said assembly comprising a groove formed in the inside wall of said distributor housing, said groove having a thickness sufficiently large to accept the radially outer edge portion of said stationary plate and a retainer means, whereby said assembly can be mounted in said groove in said distributor housing by removal or mounting of said retainer means in said groove in juxtaposition to said radial outer edge portion of said stationary plate.

3. The combination of claim 2, said retainer means comprising a split ring retainer spring.

4. The combination of claim 1, said means for mounting said assembly in said housing cooperable between said housing and said assembly comprising a shoulder formed on the inside of said distributor housing and adapted to seat the radial outer edge portion of said stationary plate thereon, said retainer means further comprising at least one set screw mounted in a suitably formed threaded opening in the wall of said distributor housing and cooperating with said radial outer edge portion of said stationary plate.

5. The combination of claim 4, said at least one set screw comprising a pair of said set screws.

6. The combination of claim 4, said at least one set screw being formed with a point, and said set screw being so positioned with respect to said shoulder that said point of said set screw bites into and at least slightly deforms the material of said stationary plate in order to securely but fixedly hold said assembly in position on said shoulder via said stationary plate.

7. The combination of claim 1, said means to permit relative rotational motion between said movable plate and said stationary plate comprising an intermediate bushing mounted on said assembly such as to have surfaces in contact with each of said main bushing, said movable plate, and said stationary plate.

8. The combination of claim 1, said finger spring means comprising at least one multi-armed finger spring, said main bushing being formed with a groove, means to mount said at least one multi-armed finger spring in said groove, and means to prevent relative motion of said multi-armed finger spring with respect to said groove in said main bushing.

9. The combination of claim 8, said means to prevent relative motion comprising a tongue portion extending radially inwardly of said multi-armed finger spring, a cooperating opening formed in said main bushing, and said tongue of said spring arm fitting into said opening in such a manner as to slightly deform the material of said bushing.

10. The combination of claim 8, said multi-armed finger spring being formed with at least four arms extending radially outwardly thereof, each of said arms being normally biased out of the plane of the central portion of said finger spring, and all of said arms being urged out of their normal position to thereby bear against one of said movable plate and said stationary plate of said assembly to thereby hold said assembly together.

11. The combination of claim 10, said finger spring being formed with six of said spring fingers spaced uniformly around a central portion containing said tongue portion which fits into said opening in said main bushing, said finger spring being formed with a tongue, and said main bushing being formed with an opening to receive said tongue to thereby locate said finger spring on said main bushing.

12. The combination of claim 10, said finger spring being formed with four of said spring fingers, and two of said four finger finger springs being used in said assembly to thereby produce the effect of an eight finger finger spring, said main bushing being formed with a pair of spaced openings to receive the tongues of each of said four finger finger springs individually.

* * * * *